US011418872B2

(12) United States Patent
Nakamura

(10) Patent No.: US 11,418,872 B2
(45) Date of Patent: Aug. 16, 2022

(54) RECORDING AND PLAYBACK DEVICE

(71) Applicant: TEAC CORPORATION, Tokyo (JP)

(72) Inventor: Susumu Nakamura, Tokyo (JP)

(73) Assignee: TEAC CORPORATION, Tokyo (JP)

( * ) Notice: Subject to any disclaimer, the term of this patent is extended or adjusted under 35 U.S.C. 154(b) by 0 days.

(21) Appl. No.: 17/126,190

(22) Filed: Dec. 18, 2020

(65) Prior Publication Data

US 2021/0195320 A1 Jun. 24, 2021

(30) Foreign Application Priority Data

Dec. 23, 2019 (JP) ..... JP2019-231627

(51) Int. Cl.
*H04R 1/32* (2006.01)
*H04R 1/40* (2006.01)
*H04R 3/00* (2006.01)

(52) U.S. Cl.
CPC ..... *H04R 1/326* (2013.01); *H04R 1/403* (2013.01); *H04R 3/005* (2013.01); *H04R 2430/20* (2013.01)

(58) Field of Classification Search
CPC ..... H04R 1/326; H04R 1/403; H04R 3/005; H04R 2203/12; H04R 2430/20; H04R 2430/23
(Continued)

(56) References Cited

U.S. PATENT DOCUMENTS

2009/0074204 A1* 3/2009 Nakamura ..... G10L 21/04 381/98
2012/0128166 A1 5/2012 Kim et al.
(Continued)

FOREIGN PATENT DOCUMENTS

| | | | |
|---|---|---|---|
| CN | 101393745 | A | 3/2009 |
| CN | 103181192 | A | 6/2013 |
| CN | 104243779 | A | 12/2014 |
| CN | 105611458 | A | 5/2016 |
| CN | 106790940 | A | 5/2017 |
| JP | 2004-180197 | A | 6/2004 |
| JP | 6202277 | B2 | 9/2017 |
| WO | 2012/061149 | A1 | 5/2012 |

OTHER PUBLICATIONS

Extended European Search Report dated May 21, 2021, for the corresponding European Patent Application No. 20214374.9, 9 pages.

(Continued)

*Primary Examiner* — William A Jerez Lora
(74) *Attorney, Agent, or Firm* — Seed IP Law Group LLP

(57) ABSTRACT

There is disclosed a device that can record a sound by selecting a directivity direction as desired by the user at the time of recording and can play back the sound by selecting, at the time of playback, a desired directivity direction by the user, separate from the directivity direction specified at the time of recording. The device has microphones, a touch panel for specifying a directivity direction, and a signal processing unit. A recording module performs directivity control in a direction specified on the touch panel and records audio data subjected to effect processing in a memory as directivity-controlled data, and records audio data that are not subjected to directivity control or effect processing in the memory as directivity-control unprocessed data. A playback module performs directivity control on the directivity-control unprocessed data recorded in the memory in a direction specified on the touch panel at the time of playback and performs effect processing on the resulting data, and plays back and outputs them.

17 Claims, 6 Drawing Sheets

(58) Field of Classification Search
USPC ..... 381/56, 58, 91, 92, 104, 122, 124
See application file for complete search history.

(56) References Cited

U.S. PATENT DOCUMENTS

| | | | | |
|---|---|---|---|---|
| 2013/0044894 | A1* | 2/2013 | Samsudin | H04R 3/005 381/92 |
| 2014/0376740 | A1 | 12/2014 | Shigenaga et al. | |
| 2015/0148660 | A1* | 5/2015 | Weiss | A61B 90/30 600/417 |
| 2016/0043699 | A1 | 2/2016 | Sawa et al. | |
| 2019/0037308 | A1* | 1/2019 | Wang | H04M 9/08 |
| 2019/0149918 | A1* | 5/2019 | Yang | H04R 1/406 381/92 |
| 2020/0174734 | A1* | 6/2020 | Gomes | H04R 1/10 |

OTHER PUBLICATIONS

Chinese Office Action, dated Jan. 20, 2022, for Chinese Application No. 202011529123.6 (12 pages, with English-language translation).

* cited by examiner

RECORDING AND PLAYBACK DEVICE

CROSS REFERENCE TO RELATED APPLICATION

This application claims priority to Japanese Patent Application No. 2019-231627 filed on Dec. 23, 2019, which is incorporated herein by reference in its entirety including the specification, claims, drawings, and abstract.

TECHNICAL FIELD

The present disclosure relates to a recording and playback device.

BACKGROUND

Recording and playback devices for recording and playing back speech sounds, for example, for conference or lecture use or for language learning use, have been developed for a long time.

JP 6202277 B discloses a technology of performing enhancement processing on a speech sound in a predetermined direction using speech sounds picked up by a microphone array device and adjusting the volume of the speech sound to reduce the occurrence of a large difference in volume before and after the enhancement processing to thereby enhance the user's convenience.

JP 2004-180197 A discloses a technology that has a microphone array composed of a plurality of microphones, a plurality of holding sections that hold, for each microphone, acoustic signals input from the individual microphones constituting the microphone array, an input section that inputs position information, and a focus section that performs acoustic focusing in the direction of the obtained position by means of the held acoustic signals of a plurality of channels.

Although when speech sounds are recorded in a conference or a lecture, it is desirable to control the directivity and then record the sounds, in some cases, the directivity may be erroneously controlled, or a speech sound obtained in a direction that differs from the originally intended direction may be desired to be played back later. Particularly, in the latter case, the user often wants to select a desired directivity direction at the time of playback, separate from the directivity direction specified at the time of recording, and listen to a speech sound focused in the selected directivity direction.

SUMMARY

The present disclosure provides a device that can record audio data by selecting a directivity direction as desired by the user at the time of recording and can play back the audio data by selecting a desired directivity direction by the user at the time of playback, separate from the directivity direction selected at the time of recording.

The present disclosure discloses a recording and playback device comprising a plurality of microphones, an operating section for specifying a directivity direction, a first directivity control section that performs, on audio signals picked up by the plurality of microphones, enhancement processing in a direction specified by the operating section at the time of recording, a recording section that records, in a memory, directivity-control processed audio data obtained after the processing by the first directivity control section and directivity-control unprocessed audio data before being processed by the first directivity control section, a reading section that reads out the directivity-control processed audio data and the directivity-control unprocessed audio data recorded in the memory, a second directivity control section that, when the directivity-control unprocessed audio data are read out, performs, on the read directivity-control unprocessed audio data, enhancement processing in a direction specified by the operating section at the time of playback, and a playback section that selectively plays back the read directivity-control processed audio data and the audio data processed by the second directivity control section.

In an embodiment of the present disclosure, the directivity-control processed audio data are audio data that are subjected to effect processing, and the directivity-control unprocessed audio data are audio data that are not subjected to effect processing.

In another embodiment of the present disclosure, the playback section performs the effect processing on the audio data processed by the second directivity control section, by means of parameters used in the effect processing of the directivity-control processed audio data.

In yet another embodiment of the present disclosure, the directivity-control unprocessed audio data are data in Ambisonics A-Format or B-Format.

In yet another embodiment of the present disclosure, the operating section has an annular-shaped touch panel and a group of LEDs that turn on radially when any position on the touch panel is touch operated. The embodiment may also have a Variable Speed Audition (VSA) section that is included between the reading section and the second directivity control section and makes the playback speed of a playback sound variable while keeping the pitch of the playback sound constant.

The present disclosure also discloses a recording and playback device comprising a plurality of microphones, a touch panel for specifying a directivity direction, and a digital signal processor comprising a recording module that processes audio signals picked up by the plurality of microphones and records the signals as audio data in a memory, and a playback module that plays back and outputs the audio data recorded in the memory, and in this device, the recording module records, in the memory, the audio data that are obtained by performing directivity control on the audio signals in a direction specified on the touch panel and by performing effect processing on the resulting signals as directivity-control processed data, and automatically records, in the memory, the audio data that are not subjected to directivity control or effect processing as directivity-control unprocessed data in association with the directivity-control processed data, and the playback module plays back and outputs the directivity-control processed data recorded in the memory, and according to switching operation by the user, performs directivity control on the directivity-control unprocessed data recorded in the memory in a direction specified on the touch panel at the time of playback and performs effect processing on the resulting data to thereby provide a playback output.

According to the present disclosure, the user can record audio data by selecting a directivity direction as desired at the time of recording and play back the audio data by selecting a desired directivity direction at the time of playback, separate from the directivity direction specified at the time of recording.

BRIEF DESCRIPTION OF DRAWINGS

Embodiments of the present disclosure will be described based on the following figures, wherein.

DESCRIPTION OF EMBODIMENTS

Figure 1A:
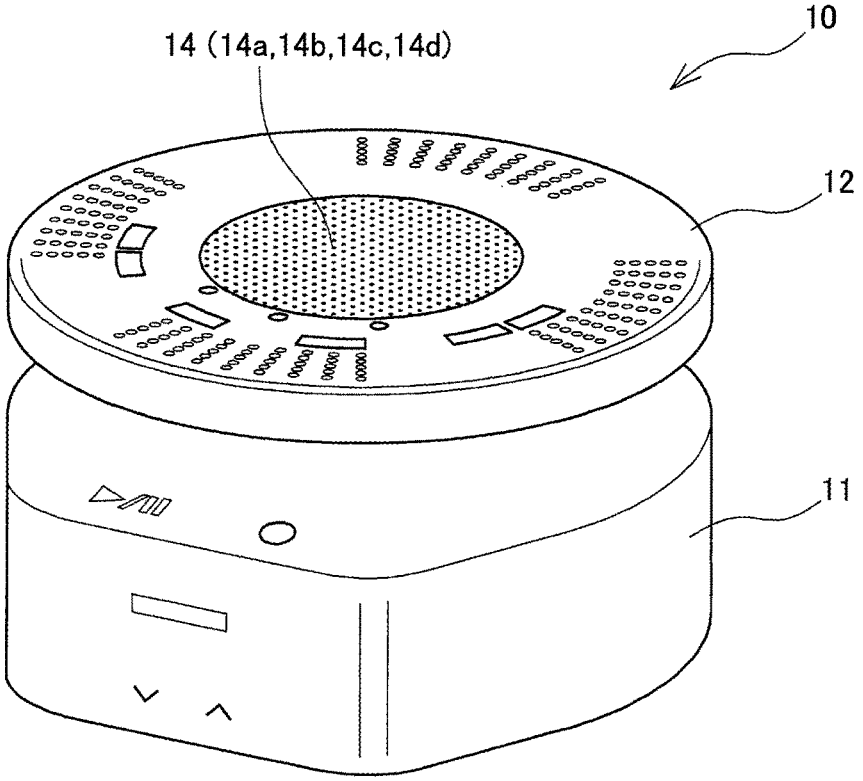
FIG. 1A is a perspective view of a recording and playback device according to an embodiment seen from a direction.

Hereinafter, embodiments of the present disclosure will be described with reference to the drawings.

Basic Principles

First, the basic principles of the present embodiment will be described below.

At the time of recording data of audio signals (audio data), such as speech sounds picked up by a plurality of microphones, in a memory, a recording and playback device according the present embodiment records both directivity-controlled audio data and directivity-uncontrolled audio data in the memory. Here, the directivity-controlled audio data refers to audio data for which the directivity of audio signals is formed in a particular direction. The user can specify a desired directivity direction by operating an operating section. A directivity control section performs enhancement processing on the audio signals picked up by the plurality of microphones in a directivity direction specified by the user to thereby output directivity-controlled audio data. Directivity control itself is publicly known, and enhancement processing is performed in a particular direction according to a delay-and-sum method, for example. Further, the directivity-uncontrolled audio data refer to audio data for which the directivity of audio signals is not formed in a particular direction. The directivity-uncontrolled audio data include not only "RAW" audio data that are not subjected to directivity control processing at all but also audio data in an intermediate state that are subjected to the processing to some extent but yet to have the directivity in a particular direction.

Ambisonics is a technology that can record and play back speech sounds in full 360 degrees in the three-dimensional space and has A-Format and B-Format. The A-Format is a format for audio data of sounds picked up by the plurality of microphones without change, and by performing conversion processing on this audio data, audio data in the B-Format are obtained. The B-Format audio data are four channel audio data composed of four audio tracks, and the four channels are respectively called W, X, Y, and Z. These W, X, Y, and Z channels are respectively composed of the following data:

W channel: omnidirectional components;

X channel: components extending in the front and rear directions;

Y channel: components extending in the left and right directions; and

Z channel: vertically extending components.

The directivity-uncontrolled audio data in the present embodiment may include both audio data in the A-Format and audio data in the B-Format.

Meanwhile, at the time of playback of the recorded audio data, the user may select the directivity-controlled audio data or the directivity-uncontrolled audio data recorded in the memory. When the user selects the directivity-controlled audio data, the directivity-controlled audio data are read out from the memory and played back from a speaker or the like as a sound output. The sound output is a speech sound subjected to enhancement processing in a direction specified by the user at the time of recording. When the user selects the directivity-uncontrolled audio data, the directivity-uncontrolled audio data are read out from the memory and undergo enhancement processing in a directivity direction specified by the user at the time of playback to thereby be played back from a speaker or the like as a sound output. The sound output is a speech sound subjected to enhancement processing in the direction specified by the user at the time of playback, separately from the directivity direction at the time of recording. The user can specify a desired directivity direction by operating the operating section at the time of playback. It is thus possible for the user to play back speech sounds by specifying a first direction as a directivity direction at a timing, play back the speech sounds by specifying a second direction that differs from the first direction as the directivity direction at another timing, and play back the speech sounds by specifying a third direction that differs from the first and second directions as the directivity direction at yet another timing. In the present embodiment, at the time of playback, it is possible to specify, in real time, a directivity direction that differs from the directivity direction at the time of recording, play back a sound, and monitor the played back sound. When the user selects the directivity-uncontrolled audio data at the time of playback, the directivity-controlled audio data and the directivity-uncontrolled audio data may be read out in parallel, instead of reading the directivity-uncontrolled audio data after the selection is made.

As a specific example, it is assumed that speech sounds are recorded in a conference. At the time of recording, recording is performed by setting the directivity to a first direction using a position of the recording and playback device as a reference. At this time, both the audio data subjected to directivity control in the first direction and directivity-uncontrolled audio data are recorded in the memory.

At the time of playback, the user first selects and plays back the directivity-controlled audio data. Here, because the audio data are subjected to directivity control in the first direction, a speech sound subjected to enhancement processing in the first direction is played back. Meanwhile, when, at the time of playback, the user wants to play back a speech sound in a second direction that differs from the first direction, the user selects the directivity-uncontrolled audio data and operates the operating section to specify the second direction. The recording and playback device then performs, on the directivity-uncontrolled audio data, directivity control processing in the second direction to play back the speech sound subjected to enhancement processing in the second direction. Further, when, at the time of playback, the user wants to play back a speech sound in a third direction that differs from the first and second directions, the user selects the directivity-uncontrolled audio data and operates the operating section to specify the third direction. The recording and playback device then performs, on the directivity-uncontrolled audio data, directivity control processing in the third direction to play back the speech sound subjected to enhancement processing in the third direction.

In the present embodiment, the directivity-uncontrolled audio data are recorded in the memory because directivity control processing cannot be performed again on the directivity-controlled audio data. In other words, in the present embodiment, the directivity-uncontrolled audio data have a technical significance of not only functioning as backup data in case the directivity-controlled audio data are damaged for some reasons but also functioning as audio data which are a base for performing directivity control, separately from directivity control at the time of recording.

Structure

Next, the structure of the recording and playback device according to the present embodiment will be described.

Figure 1B:
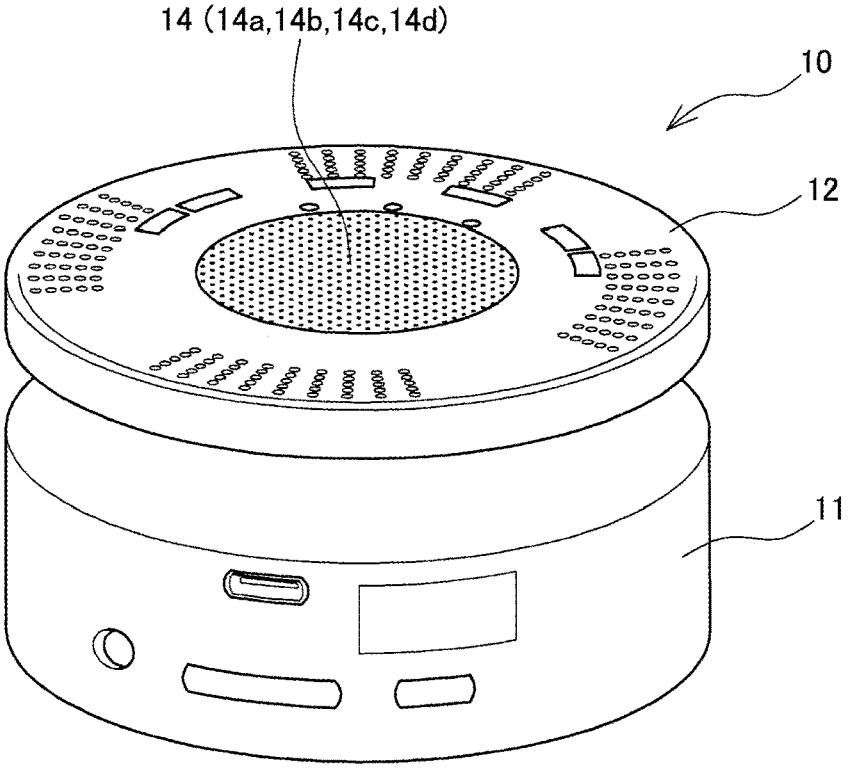
FIG. 1B is a perspective view of the recording and playback device according to the embodiment seen from another direction.

FIGS. 1A and 1B show perspective views of a recording and playback device 10 according to the present embodiment. FIG. 1A is a perspective view seen from a certain direction, and FIG. 1B is a perspective view seen from a direction that differs from that in FIG. 1A (opposite direction).

The recording and playback device 10 has a generally cylindrical external shape. The recording and playback device 10 has a touch panel 12 in its upper part and a plurality of microphones 14 (14*a*, 14*b*, 14*c*, and 14*d*) inside. The recording and playback device 10 also has a base 11 in its lower part, and the bottom surface of the base 11 is located on a table surface of a conference room, for example.

The touch panel 12 in the upper part has a generally circular shape and displays states of various types. The various types of states include the states of stereo, 360 degrees, focus, and volume, for example. Here, the state of 360 degrees refers to the omnidirectional state. The state of focus refers to the state of directivity. An outer annular portion of the touch panel 12 has groups of LEDs radially arranged from the center toward the outside.

The touch panel 12 functions as the operating section in the present embodiment. To specify a desired directivity direction, the user touches a corresponding position on the outer annular portion. The touch operation by the user is detected by a signal processing unit provided in the base 11 in the lower part of the recording and playback device 10. Although, more specifically, the touch operation is detected and output to the signal processing unit of the base 11 as a detection signal by a microcomputer mounted in the touch panel 12 and received and processed by the signal processing unit, the present embodiment will be described assuming that the signal processing unit including the microcomputer mounted in the touch panel 12 detects the touch operation.

The base 11 in the lower part has various types of operation switches, such as a power switch, a recording switch, a playback switch, and a stop switch, as well as various types of operation buttons, such as a menu button and an enter button. It also has various types of connectors, such as a USB connector, an earphone jack, and a memory slot. The memory slot is a slot into which, for example, an SD memory is inserted, but this is not limiting, and any recording medium may be used. The base 11 in the lower part is also provided with the signal processing unit that processes audio signals picked up by the plurality of microphones.

The user places the recording and playback device 10 on the table or the like in the conference room and activates it by turning on the power switch. The user then turns on the recording switch to start recording. To perform omnidirectional recording, the user keeps the default settings without touching the outer annular portion of the touch panel 12. In the default settings, the recording and playback device 10 records audio data picked up by the plurality of microphones 14 (14*a*, 14*b*, 14*c*, 14*d*) without performing directivity control processing on a memory. At this time, the LEDs of "360 degrees" indicating that omnidirectional recoding is being performed turn on.

Meanwhile, when the user wants to enhance a sound in a particular direction, for example, a speech sound from a speaker present in a particular direction in a conference, the user touches a position on the outer annular portion of the touch panel 12 corresponding to the direction using a position where the recording and playback device 10 is located as a reference. The signal processing unit detects the user's touch, performs directivity control in the direction of the touch, and records the resulting data in the memory. When the user touches the position on the outer annular portion, the group of LEDs at the touched position turn on, and the directivity direction can thus be visually recognized.

Figure 2:
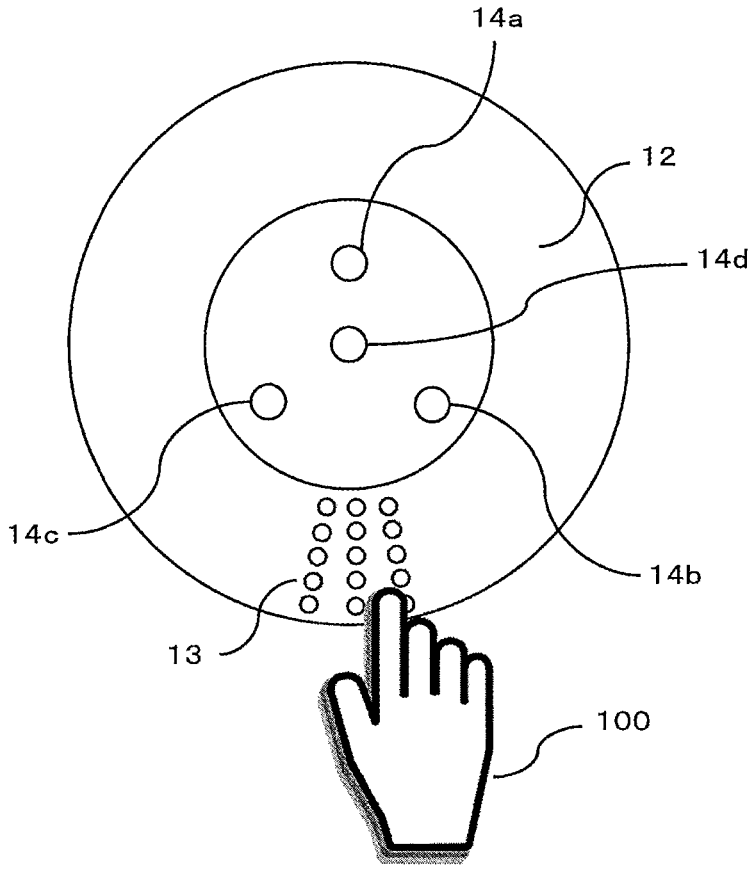
FIG. 2 is a schematic plan view of the recording and playback device according to the embodiment.

FIG. 2 schematically shows the user performing touch operation on the outer annular portion of the touch panel 12. As the plurality of microphones 14, the four microphones 14*a*, 14*b*, 14*c*, and 14*d* are included inside the upper part of the recording and playback device 10. The arrangement positions of the four microphones 14*a*, 14*b*, 14*c*, and 14*d* are the apices and the center of gravity of the equilateral triangle, but are not limited to them. Some of the four microphones 14*a*, 14*b*, 14*c*, and 14*d* may be used for high frequencies, and the others may be used for mid and low frequencies. The four microphones 14*a*, 14*b*, 14*c*, and 14*d* are, for example, omnidirectional condenser microphones, but are not limited to them.

When the user touches a particular position on the outer annular portion of the touch panel 12 with a finger 100, the signal processing unit detects this touch operation and turns on the group of LEDs 13 radially arranged at the touched position. The signal processing unit then performs directivity control processing on audio data picked up by the four microphones 14*a*, 14*b*, 14*c*, and 14*d* using the touched direction as the directivity direction. When the user touches another position with the finger 100, the signal processing unit detects this touch operation and turns on another group of LEDs radially arranged at the touched position. The signal processing unit then performs directivity control processing on the audio data picked up by the four microphones 14*a*, 14*b*, 14*c*, and 14*d* using the touched direction as the directivity direction. Turning on the group of radially arranged LEDs allows not only the user operating the recording and playback device 10 but also the other participants of the conference or the like to easily visually recognize the direction in which the directivity is currently being controlled.

Figure 3:
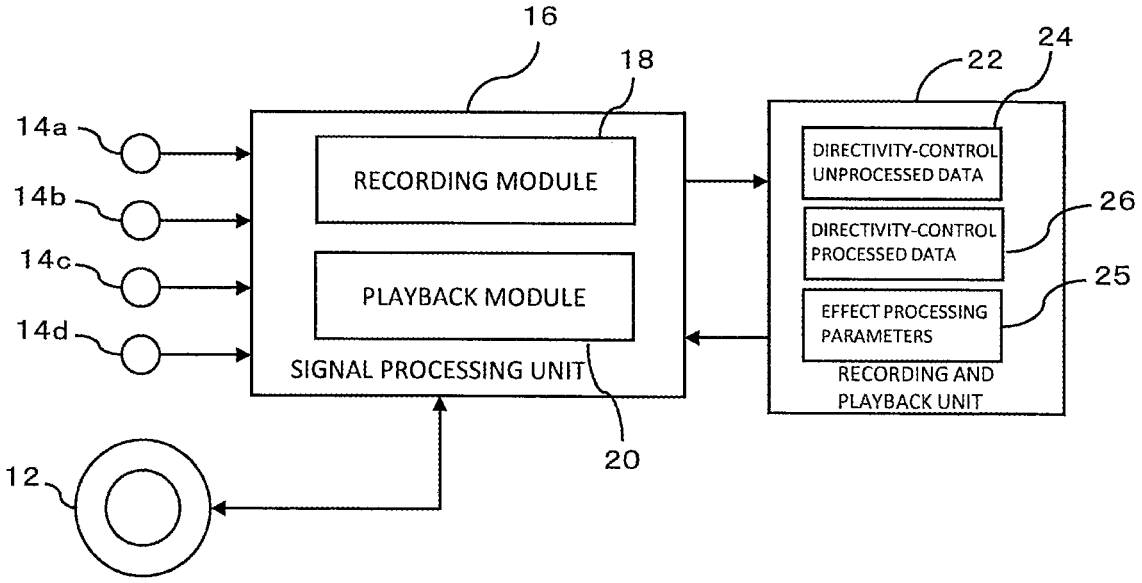
FIG. 3 is a functional block diagram of the recording and playback device according to the embodiment.

FIG. 3 shows a functional block diagram of the recording and playback device 10 according to the present embodiment. The recording and playback device 10 has the touch panel 12, the four microphones 14*a*, 14*b*, 14*c*, and 14*d*, a signal processing unit 16, and a recording and playback unit 22. In addition to them, the recording and playback device 10 has the various types of switches and buttons, such as the power switch and the recording switch, connectors such as the USB connector, and interfaces, but these are omitted from the illustration.

The signal processing unit 16 includes a recording module 18 and a playback module 20. The recording module 18 includes an A/D conversion unit, a beamforming unit, and an effect unit. The recording module 18 digitizes audio signals picked up by the four microphones 14*a*, 14*b*, 14*c*, and 14*d*, converts the results into audio data, performs directivity control processing and effect processing on the audio data, and outputs the results to the recording and playback unit 22. The directivity control processing is performed by the beamforming unit. The beamforming unit converts audio data from the four microphones 14*a*, 14*b*, 14*c*, and 14*d* into audio data in the B-Format which uses the following four channels:

W channel: omnidirectional components;

X channel: components extending in the front and rear directions;

Y channel: components extending in the left and right directions; and

Z channel: vertically extending components.

The beamforming unit then forms the directivity of the audio data. Specifically, the signal processing unit 16 detects a position on the touch panel 12 touched by the user and determines a directivity direction according to the touched position. The beamforming unit adds, for example, delay times corresponding to differences in arrival time among the four microphones 14*a*, 14*b*, 14*c*, and 14*d* to the audio data based on the determined directivity direction, and sums the audio data subjected to delay processing to thereby form the directivity. The effect unit performs various types of effect processing on the audio data subjected to directivity control by the beamforming unit. The effect processing includes limiting processing, filtering processing, equalizing processing, and the like.

The recording module 18 outputs the audio data subjected to the directivity control processing and the effect processing to the recording and playback unit 22 as directivity-control processed data.

In parallel with the above directivity control processing and effect processing, the recording module 18 outputs audio data which are not subjected to the directivity control processing; that is, A-Format data or B-Format data, to the recording and playback unit 22 as directivity-control unprocessed data. The directivity-control unprocessed data are not even subjected to the effect processing in the effect processing unit. In other words, the recording module 18 outputs the A-Format data or the B-Format data to the recording and playback unit 22 as the directivity-control unprocessed data without performing the directivity control processing or the effect processing on it.

This parallel processing in the recording module 18 is automatically performed independently of the user operation. At the time of recording, the recording module 18 thus outputs the directivity-control unprocessed data and the directivity-control processed data to the recording and playback unit 22 every time. The recording module 18 also outputs the directivity-control unprocessed data to the recording and playback unit 22 automatically even when the user specifies omnidirectional recording of audio data at the time of recording. In this case, the directivity-uncontrolled data and the directivity-controlled data differ in the presence of effect processing.

The recording and playback unit 22 has a memory slot and a write circuit for writing data to a recording medium, such as, for example, an SD memory inserted in the memory slot. The write circuit records directivity-uncontrolled data 24 and directivity-controlled data 26 output from the recording module 18 by writing them into the SD memory inserted in the memory slot or the like. The write circuit writes the directivity-uncontrolled data 24 and the directivity-controlled data 26 as a pair when it writes them in the memory. That is, the directivity-uncontrolled data 24 and the directivity-controlled data 26 are associated with each other when written in the memory. As such, the directivity-uncontrolled data 24 and the directivity-controlled data 26 are written and recorded in the memory in association with each other so that the directivity-uncontrolled data 24, which make a pair with the directivity-controlled data 26, can be easily identified and read out when the user operates to play back the directivity-controlled data 26.

The recording and playback unit 22 also has a read circuit that reads out the data recorded in the memory. According to the operation of selecting and determining a file to be played back and the subsequent operation of operating the playback switch by the user, the read circuit reads out directivity-controlled data 26 of the file which is recorded in the memory and specified by the user and outputs the data to the playback module 20.

The playback module 20 plays back the directivity-controlled data 26 read out by the read circuit and outputs the playback data to an earphone jack or a speaker.

Meanwhile, when, during playback of the directivity-controlled data 26, the user wants to listen to a speech sound subjected to directivity control in a directivity direction that differs from that at the time of recording, the user performs the switching operation to play back the directivity-uncontrolled data 24 and touches the touch panel 12 to specify the different directivity direction.

According to this switching operation by the user, the read circuit of the recording and playback unit 22 reads out the directivity-uncontrolled data 24 associated with the directivity-controlled data 26 that have been read from the memory until then, and outputs the directivity-uncontrolled data 24 to the playback module 20.

The playback module 20 performs directivity control processing and effect processing on the directivity-uncontrolled data 24 read out by the read circuit and plays back and outputs the results to an earphone jack or a speaker. Specifically, the playback module 20 has a beamforming unit, an effect unit, and a D/A converting unit, and it performs directivity control processing and effect processing on the directivity-uncontrolled data 24 and converts the resulting data to analog audio signals by the D/A converting unit, to thereby output the analog audio signals to a speaker or the like. Like the beamforming unit of the recording module 18, the beamforming unit of the playback module 20 adds, for example, delay times corresponding to differences in arrival time among the four microphones 14*a*, 14*b*, 14*c*, and 14*d* to the audio data based on the directivity direction determined according to the position on the touch panel 12 touched by the user, and sums the audio data subjected to delay processing to thereby form the directivity. Like the effect unit of the recording module 18, the effect unit of the playback module 20 performs various types of effect processing on the audio data subjected to directivity control by the beamforming unit. The effect processing includes limiting processing, filtering processing, equalizing processing, and the like.

Although each of the recording module 18 and playback module 20 in the present embodiment has the beamforming unit and the effect unit, the modules may share these units. Specifically, at the time of recording, the recording module 18 may perform directivity control processing and effect processing by the shared beamforming unit and the shared effect unit to thereby generate the directivity-controlled 26 data and record them in the memory, while, at the time of playback, the playback module 20 may perform directivity control processing and effect processing by the shared beamforming unit and the shared effect unit to thereby generate and play back the directivity-uncontrolled data 24.

Further, when the effect processing unit of the playback module 20 performs effect processing, it is desirable to perform the same effect processing as the effect processing performed on the directivity-controlled data 26 associated with the directivity-uncontrolled data 24 to be processed. To this end, various types of parameters 25 used in the effect processing performed at the time of recording may be recorded in the recording medium of the recording and playback unit 22 in association with the directivity-uncontrolled data 24 and the directivity-controlled data 26, and the parameters 25 may be read out from the recording medium and used when the effect processing unit of the playback module 20 performs effect processing. Thus, an auditory difference can be reduced at the time of switching between the directivity-controlled data 26 and the directivity-uncontrolled data 24.

Figure 4:
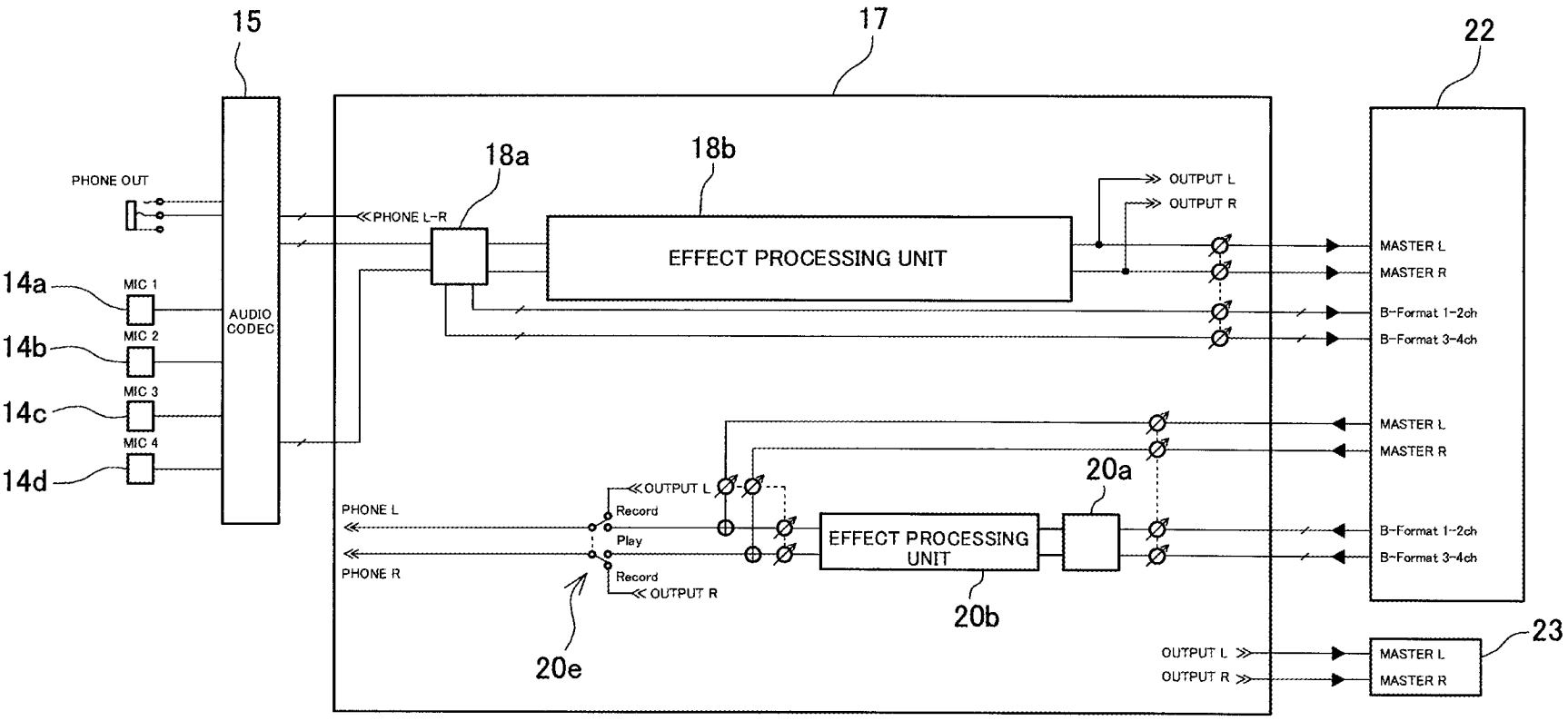
FIG. 4 is a circuit structure diagram of the recording and playback device according to the embodiment.

FIG. 4 shows a specific circuit structure of the recording and playback device 10 according to the present embodiment. The signal processing unit 16 is composed of an audio codec 15 and a digital signal processor (DSP) 17. The microphones 14*a* to 14*d* are connected to the audio codec 15.

The audio codec 15 receives audio signals from the microphones 14*a* to 14*d* as inputs, digitizes and converts these analog audio signals to audio data, and outputs the data to the DSP 17. The audio codec 15 also converts stereo audio data (PHONE L, R) played back by the DSP 17 into analog audio signals and outputs them.

The DSP 17 has the beamforming unit and the effect unit. The DSP 17 has a beamforming module 18*a* as the beamforming unit. The DSP 17 has an effect processing unit 18*b* as the effect unit.

The beamforming module 18*a* and the effect processing unit 18*b* are connected to each other in series.

The beamforming module 18*a* includes a delayer and an adder and receives audio data from the audio codec 15 as an input and converts this audio data (A-Format data) into B-Format data of four channels. The beamforming module 18*a* then performs directivity control processing on the B-Format data in the directivity direction specified by the user based on, for example, a delay-and-sum method by means of the delayer and the adder, and outputs audio data of two channels (L channel and R channel) to the effect processing unit 18*b*. The beamforming module 18*a* also outputs the B-Format data of four channels to the recording and playback unit 22 as B-Format channels 1 and 2 and B-Format channels 3 and 4 without performing directivity control processing on them.

The effect processing unit 18*b* performs various types of effect processing including, for example, limiting processing, equalizing processing, and DeEsser processing. When the audio data subjected to directivity control by the beamforming module 18*a* have a volume level that exceeds a preset threshold, in limiting processing, the volume level is reduced to prevent excessive signal level. In equalizing processing, a particular frequency band of the audio data subjected to volume level adjustment in the limiting processing undergoes enhancement processing or attenuation processing. The equalizing processing includes filtering processing for cutting off high-frequency components with much noise. In DeEsser processing, the audio data subjected to the equalizing processing undergo compressing processing particularly in its high-frequency region.

The audio data of the two channels subjected to the directivity control processing and the effect processing by the beamforming module 18*a* and the effect processing unit 18*b* are output to the recording and playback unit 22 as master signals (MASTER L and MASTER R).

The write circuit of the recording and playback unit 22 writes, in the SD memory or the like, the master signals (MASTER L and MASTER R) as directivity-control processed data and the B-Format channels 1 and 2 and the B-Format channels 3 and 4 as directivity-control unprocessed data, thereby recording them.

The effect processing unit 18*b* may add a slate tone which is output from a generator and functions as a reference for alignment to the audio data and output the resulting data to the recording and playback unit 22.

The master signals to which the slate tone is added are not only output to the recording and playback unit 22 but also to a USB connector 23 as output signals (OUTPUT L and OUTPUT R).

Meanwhile, the playback module 20 has a beamforming module 20*a* and an effect processing unit 20*b*. The beamforming module 20*a* and the effect processing unit 20*b* are connected to each other in series.

The beam forming module 20*a* receives, as inputs, the B-Format channels 1 and 2 and the B-Format channels 3 and 4 read out from the memory by the read circuit of the recording and playback unit 22, performs directivity control processing on the B-Format data in the directivity direction specified by the user, and outputs audio data of two channels (L channel and R channel) to the effect processing unit 20*b*.

The effect processing unit 20*b* performs various types of effect processing; that is, limiting processing, equalizing processing, DeEsser processing, and the like.

Effect processing in the effect processing unit 20*b* is similar to that in the effect processing unit 18*b*, and various types of parameters 25 that are used for the effect processing in the effect processing unit 18*b* are read out from the recording medium of the recording and playback unit 22 and used. As a matter of course, the effect processing in the effect processing unit 20*b* may differ from that in the effect processing unit 18*b*. The effect processing unit 20*b* outputs audio data subjected to the directivity control processing and the effect processing to a changeover switch 20*e*.

The master signals (MASTER L and MASTER R) selectively read out from the memory by the read circuit of the recording and playback unit 22 are also output to the changeover switch 20*e* without passing through the beamforming module 20*a* or the effect processing unit 20*b*.

According to the user operation, the changeover switch 20*e* switches either one of the audio data subjected to the directivity control processing and the effect processing and the master signals between "recording" and "playback" to thereby output the result. When the changeover switch 20*e* is switched to "recording", either the audio data or the master signals are output to the USB connector 23. Further, when the changeover switch 20*e* is switched to "playback", either the audio data or the master signals are output to the earphone jack (PHONE L and PHONE R) or the speaker.

Process Flowchart

Figure 5:
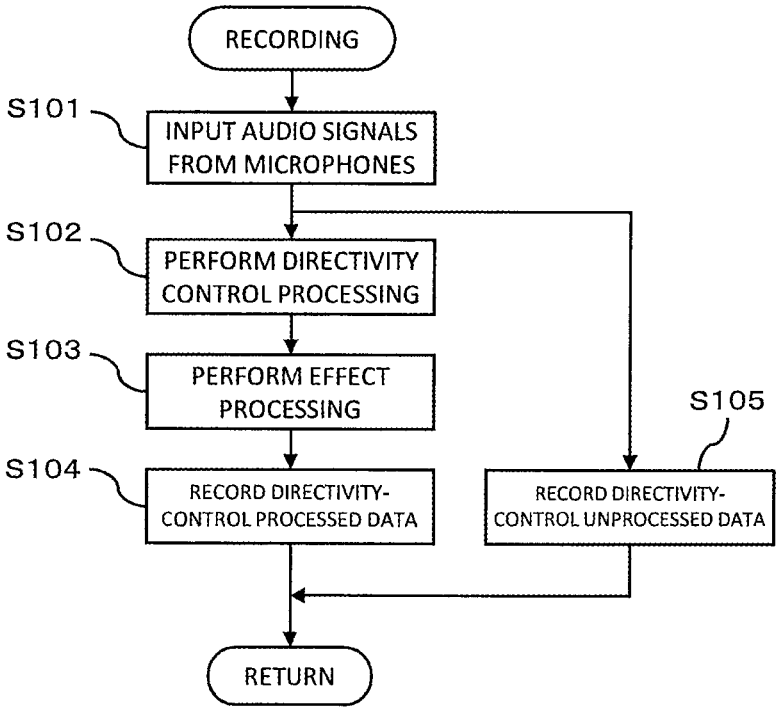
FIG. 5 is a processing flowchart of recording according to the embodiment.

FIG. 5 shows a process flowchart of recording by the recording and playback device 10 according to the present embodiment. When the user turns on the power switch and then the recording switch, audio signals are picked up and received as inputs through the four microphones 14*a*, 14*b*, 14*c*, and 14*d* and then output to the signal processing unit 16 (S101).

The signal processing unit 16 converts the analog audio signals from the four microphones 14*a*, 14*b*, 14*c*, and 14*d* to digital audio data and performs directivity control processing in a direction specified by the user by touching the outer annular portion of the touch panel 12 by the user (S102). During this processing, the signal processing unit 16 specifically performs the following processing of:

detecting a position on the touch panel 12 touched by the user;

turning on a group of radial LEDs corresponding to the touched position;

determining a directivity direction according to the touched position;

performing enhancement processing in the determined directivity direction; and turning on the LEDs indicating that directivity control is being performed in the direction.

When the user does not touch the outer annular portion of the touch panel 12, the signal processing unit 16 performs omnidirectional recording (360 degrees) which is set as a default, and thus it does not perform the processing of S102.

The signal processing unit 16 then performs the effect processing on the audio data subjected to the directivity control processing (or on the omnidirectional audio data obtained based on the default settings as the user does not touch the touch panel) (S103). The signal processing unit 16 outputs the audio data subjected to the directivity control processing and the effect processing to the recording and playback unit 22 as directivity-control processed data, and the write circuit of the recording and playback unit 22 records this directivity-control processed data in the memory (S104).

Further, in parallel with the processing in S102 to S104, the signal processing unit 16 outputs audio data which are not subjected to the directivity control process; specifically, A-Format data or B-Format data, to the recording and playback unit 22 as directivity-control unprocessed data, and the write circuit of the recording and playback unit 22 records this directivity-control unprocessed data in the memory (S105).

Figure 6:
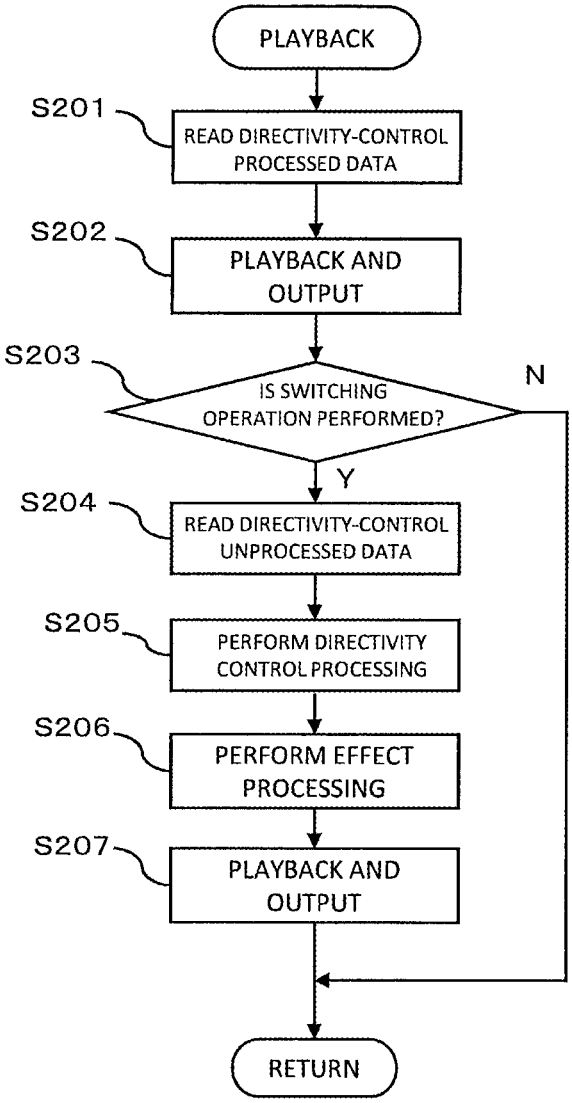
FIG. 6 is a processing flowchart of playback according to the embodiment.

FIG. 6 shows a process flowchart of playback by the recording and playback device 10 according to the present embodiment.

When the user turns on the playback switch, in the default state, the read circuit of the recording and playback unit 22 reads out the directivity-controlled data from the memory and outputs it to the signal processing unit 16 (S201).

The signal processing unit 16 plays back and outputs the read directivity-control processed data (S202).

Meanwhile, the signal processing unit 16 determines whether or not the switching operation has been performed by the user (S203). If the switching operation has not been performed by the user, the signal processing unit 16 continues to play back and output the directivity-control processed data without change (NO in S203).

If the switching operation has been performed by the user (YES in S203), the read circuit of the recording and playback unit 22 reads out the directivity-control unprocessed data recorded in association with the directivity-control processed data, which are read out in S201, and outputs them to the signal processing unit 16 (S204).

The signal processing unit 16 performs the directivity-control processing on the read directivity-control unprocessed data (S205). At this time, like at the time of recording, the signal processing unit 16 performs the following processing of:

detecting a position on the touch panel 12 touched by the user;

turning on a group of radial LEDs corresponding to the touched position;

determining a directivity direction according to the touched position;

performing enhancement processing in the determined directivity direction; and turning on the LEDs indicating that directivity control is being performed in the direction.

The signal processing unit 16 then performs the effect processing on audio data subjected to the directivity control processing (S206). The audio data subjected to the directivity control processing and the effect processing are played back and output (S207).

As such, the user can play back and listen to a speech sound of the audio data which are subjected to directivity control and recorded in the memory at the time of recording. In addition to this, when the user wants to listen to a speech sound played back in a directivity direction that differs from the directivity direction at the time of recording, the user can listen to the speech sound subjected to desired directivity control by operating the touch panel 12 again at the time of playback to specify the different directivity direction. This is effective when, at the time of playback, a speech of a speaker present in a particular direction from the recording and playback device 10 serving as a reference is desired to be particularly enhanced.

OTHER EMBODIMENTS

Although, in the present embodiment, the directivity direction has been specified by the user by touching the outer annular portion of the touch panel 12, it is also possible to specify a directivity direction by specifying three-dimensional coordinates of a desired position in the three-dimensional coordinate system in which the recording and playback device 10 serves as a reference. The directivity direction may be specified, for example, by means of a PC, a tablet terminal, or a smart phone that is wired or wirelessly connected to the recording and playback device 10 in a manner that data can be transmitted and received to and from the recording and playback device 10, and by means of an application installed in such information devices.

In the present embodiment, it is also possible to include a Variable Speed Audition (VSA) function that makes the playback speed of a playback sound variable while keeping the pitch of the playback sound constant.

Figure 7:
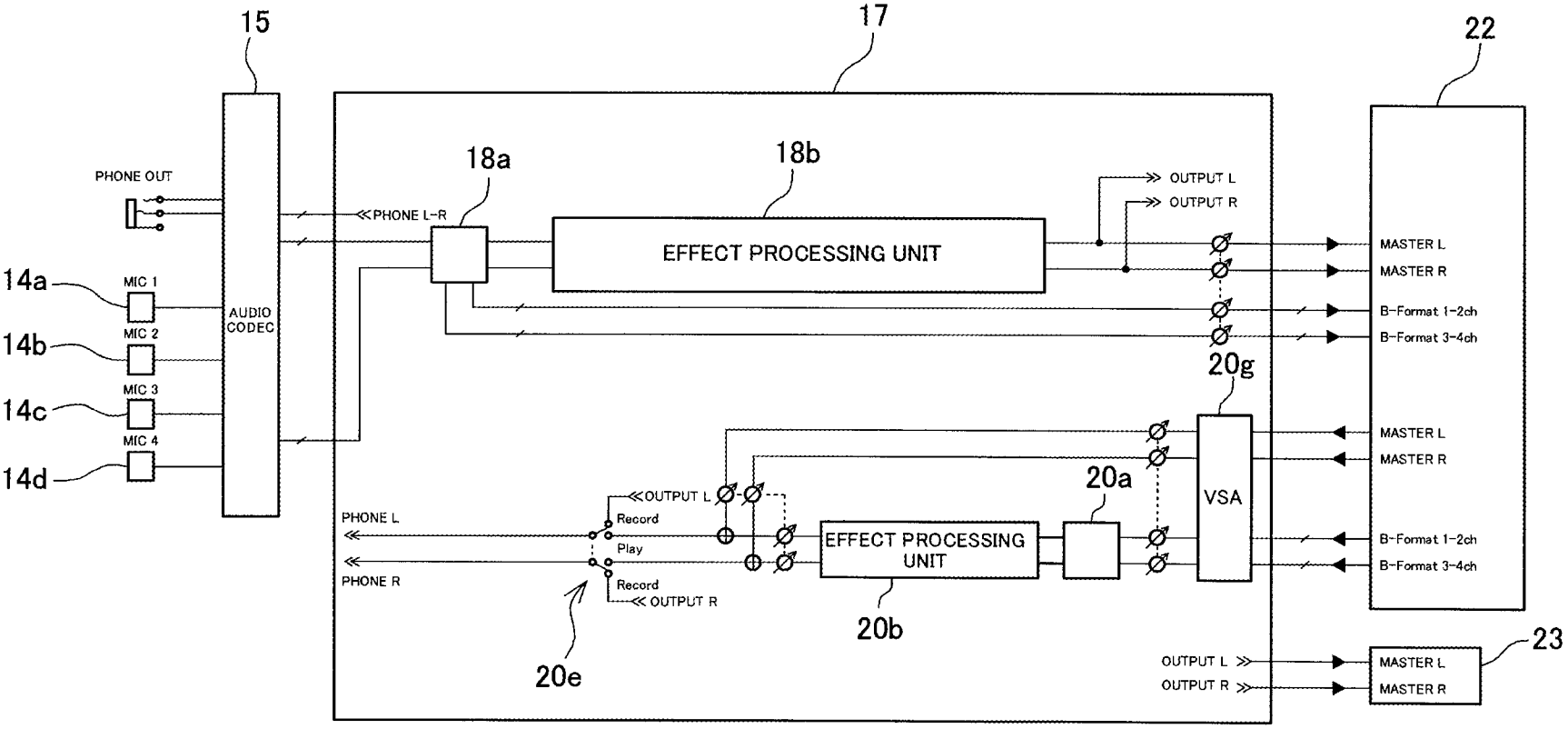
FIG. 7 is a circuit structure diagram of another embodiment.

FIG. 7 is a circuit structure diagram of the recording and playback device 10 having the VSA function. FIG. 7 differs from FIG. 4 in that a VSA module 20*g* is provided between the recording and playback unit 22 and the playback module 20. The user increases or decreases the playback speed by operating a plus button or a minus button while a playback control screen is displayed on the base 11. According to this user operation, the VSA module 20*g* adjusts the increase/decrease of the playback speed.

Although it is also possible to provide the VSA module 20*g* after the playback module 20, instead of between the recording and playback unit 22 and the playback module 20, in this case, a separate memory is required before the VSA module 20*g* to store audio data, and the number of parts thus increases (in contrast to this, if the VSA module 20*g* is provided before the playback module 20, a separate memory is not required). Therefore, from the viewpoints of reducing the number of parts and reducing cost, it is desirable to provide the VSA module 20*g* before the playback module 20 as shown in FIG. 7.

The invention claimed is:

1. A recording and playback device comprising:

a plurality of microphones;

a touch panel surrounding the plurality of microphones;

a first directivity control section that performs, on audio signals picked up by the plurality of microphones, enhancement processing in a first directivity direction specified at a time of recording in response to detection of a first touch operation at a first position on the touch panel;

a recording section that records, in a memory, directivity-control processed audio data obtained after the processing by the first directivity control section and directivity-control unprocessed audio data before being processed by the first directivity control section;

a reading section that reads out the directivity-control processed audio data and the directivity-control unprocessed audio data recorded in the memory;

a second directivity control section that, when the directivity-control unprocessed audio data are read out, performs, on the read directivity-control unprocessed audio data, enhancement processing in a second directivity direction specified at a time of playback in response to detection of a second touch operation at a second position on the touch panel; and a playback section that selectively plays back the read directivity-control processed audio data and the audio data processed by the second directivity control section.

2. The recording and playback device according to claim 1, wherein the directivity-control processed audio data are audio data subjected to effect processing, and the directivity-control unprocessed audio data are audio data that are not subjected to effect processing.

3. The recording and playback device according to claim 2, wherein the playback section performs effect processing on the audio data processed by the second directivity control section, using parameters used in the effect processing of the directivity-control processed audio data.

4. The recording and playback device according to claim 1, wherein the directivity-control unprocessed audio data are data in Ambisonics A-Format or B-Format.

5. The recording and playback device according to claim 1, wherein:

the touch panel is an annular-shaped touch panel including a plurality of groups of light emitting devices, each group of light emitting devices is radially arranged between a center portion and an outer portion of the annular-shaped touch panel, a first group of the light emitting devices at the first position on the touch panel turns on in response to the detection of the first touch operation at the first position on the touch panel, and a second group of the light emitting devices at the second position on the touch panel turns on in response to the detection of the second touch operation at the second position on the touch panel.

6. The recording and playback device according to claim 1, further comprising a Variable Speed Audition section that is included between the reading section and the second directivity control section and makes the playback speed of a playback sound variable while keeping the pitch of the playback sound constant.

7. A recording and playback device comprising:

a plurality of microphones;

a touch panel surrounding the plurality of microphones; and a digital signal processor comprising a recording module that processes audio signals picked up by the plurality of microphones and records the resulting signals as audio data in a memory, and a playback module that plays back and outputs the audio data recorded in the memory, wherein the recording module:

records, in the memory, the audio data that are obtained by performing directivity control processing on the audio signals in a first directivity direction specified at a time of recording in response to detection of a first touch operation at a first position on the touch panel and by performing effect processing on signals resulting from performing the directivity control processing on the audio signals in the first directivity direction, as directivity-control processed data, and automatically records, in the memory, the audio data that are not subjected to directivity control and effect processing as directivity-control unprocessed data in association with the directivity-control processed data, and the playback module:

plays back and outputs the directivity-control processed data recorded in the memory, and according to detection of a switching operation, performs directivity control processing on the directivity-control unprocessed data recorded in the memory in a second directivity direction specified at a time of playback in response to detection of a second touch operation at a second position on the touch panel and performs effect processing on the data resulting from performing the directivity control processing on the on the directivity-control unprocessed data in the second directivity direction to thereby provide a playback output.

8. The recording and playback device according to claim 7, wherein the playback module performs effect processing on the directivity-control unprocessed data using parameters used in the effect processing of the directivity-control processed audio data.

9. The recording and playback device according to claim 7, wherein the directivity-control unprocessed audio data are data in Ambisonics A-Format or B-Format.

10. The recording and playback device according to claim 7, wherein:

the touch panel is an annular-shaped touch panel including a plurality of groups of light emitting devices, each group of light emitting devices is radially arranged between a center portion and an outer portion of the annular-shaped touch panel, a first group of the light emitting devices at the first position on the touch panel turns on in response to the detection of the first touch operation at the first position on the touch panel, and a second group of the light emitting devices at the second position on the touch panel turns on in response to the detection of the second touch operation at the second position on the touch panel.

11. The recording and playback device according to claim 7, wherein the digital signal processor further comprises a Variable Speed Audition module that makes the playback speed of a playback sound variable while keeping the pitch of the playback sound constant.

12. The recording and playback device according to claim 1, wherein the touch panel displays data indicating omnidirectional recording before the detection of the first touch operation at the first position on the touch panel.

13. The recording and playback device according to claim 1, wherein the plurality of microphones includes four microphones.

14. The recording and playback device according to claim 13, wherein:

a first microphone is located at a position of a first apex of an equilateral triangle, a second microphone is located at a position of a second apex of the equilateral triangle, a third microphone is located at a position of a third apex of the equilateral triangle, a fourth microphone is located at a position of a center of gravity of the equilateral triangle.

15. The recording and playback device according to claim 7, wherein the touch panel displays data indicating omnidirectional recording before the detection of the first touch operation at the first position on the touch panel.

16. The recording and playback device according to claim 7, wherein the plurality of microphones includes four microphones.

17. The recording and playback device according to claim 15, wherein:

a first microphone is located at a position of a first apex of an equilateral triangle, a second microphone is located at a position of a second apex of the equilateral triangle, a third microphone is located at a position of a third apex of the equilateral triangle, a fourth microphone is located at a position of a center of gravity of the equilateral triangle.

* * * * *